US007882769B2

(12) United States Patent
Lin

(10) Patent No.: US 7,882,769 B2
(45) Date of Patent: Feb. 8, 2011

(54) INSULATING SCREWDRIVER HAVING WEAR IDENTIFICATION FUNCTION

(75) Inventor: Jack Lin, Taichung (TW)

(73) Assignee: Yih Cheng Factory Co., Ltd., Taichung (TW)

( * ) Notice: Subject to any disclaimer, the term of this patent is extended or adjusted under 35 U.S.C. 154(b) by 226 days.

(21) Appl. No.: 12/211,806

(22) Filed: Sep. 16, 2008

(65) Prior Publication Data

US 2009/0095138 A1 Apr. 16, 2009

(30) Foreign Application Priority Data

Oct. 15, 2007 (TW) ..... 96217191 U

(51) Int. Cl.
*B25B 15/00* (2006.01)

(52) U.S. Cl. ..... 81/177.1; 81/436

(58) Field of Classification Search ..... 81/177.1, 81/436, 900

See application file for complete search history.

(56) References Cited

U.S. PATENT DOCUMENTS 1,225,249 A * 5/1917 Holtschneider ..... 81/436
2,899,996 A * 8/1959 Stockman ..... 81/177.1
5,259,277 A * 11/1993 Zurbuchen ..... 81/177.1
5,740,586 A * 4/1998 Gomas ..... 16/436
5,865,077 A * 2/1999 Moffitt et al. ..... 81/427.5
6,655,240 B1 * 12/2003 DeVecchis et al. ..... 81/438
6,832,996 B2 * 12/2004 Woloszko et al. ..... 606/41
7,051,630 B2 * 5/2006 Lee ..... 81/451

* cited by examiner

*Primary Examiner*—David B Thomas
(74) *Attorney, Agent, or Firm*—Banger Shia

(57) ABSTRACT

An insulating screwdriver includes a handle, a drive shank having a first end mounted in the handle and a second end protruding outwardly from the handle, an insulating jacket mounted on the second end of the drive shank, and an identification insulating sleeve mounted between the second end of the drive shank and the insulating jacket. Thus, when the insulating jacket is worn out or broken due to friction or hit, the identification insulating sleeve is still located outside of the drive shank to provide a secondary insulating effect to the drive shank so as to protect the user when operating the drive shank.

19 Claims, 5 Drawing Sheets

INSULATING SCREWDRIVER HAVING WEAR IDENTIFICATION FUNCTION

BACKGROUND OF THE INVENTION

1. Field of the Invention

The present invention relates to a screwdriver for operating a workpiece, such as a screw, bolt and the like, and more particularly to an insulating screwdriver to provide an insulating effect to a user.

2. Description of the Related Art

A conventional insulating screwdriver in accordance with the prior art shown in FIG. 5 comprises a handle 60, a drive shank 50 having a first end mounted in the handle 60 and a second end protruding outwardly from the handle 60, and an insulating jacket 70 mounted on the second end of the drive shank 50. The drive shank 50 has a first end provided with a drive tip 55 protruding outwardly from the insulating jacket 70 and a second provided with a plurality of fixing wings 51 secured in the handle 60. Thus, the insulating jacket 70 is located outside of the drive shank 50 to provide an insulating effect to the drive shank 50 so as to protect a user when operating the drive shank 50 to operate a workpiece. However, a hole or crack 75 is easily formed on the insulating jacket 70 when the insulating jacket 70 is worn out or broken due to friction or hit, thereby causing danger to the user when touching the drive shank 50 through the hole or crack 75.

SUMMARY OF THE INVENTION

The present invention is to mitigate and/or obviate the disadvantage of the conventional insulating screwdriver.

The primary objective of the present invention is to provide an insulating screwdriver having a wear identification function.

Another objective of the present invention is to provide an insulating screwdriver, wherein the identification insulating sleeve is mounted between the second end of the drive shank and the insulating jacket, so that when the insulating jacket is worn out or broken due to friction or hit during a long-term utilization, the identification insulating sleeve is still located outside of the drive shank to provide a secondary insulating effect to the drive shank so as to protect the user when operating the drive shank.

A further objective of the present invention is to provide an insulating screwdriver, wherein when the insulating jacket is worn out, the identification insulating sleeve located in the insulating jacket is exposed partially from the insulating jacket and has a color different from that of the insulating jacket to provide an identification function, so that the user can identify the wear condition of the insulating jacket, thereby achieving the safety usage of the insulating screwdriver.

In accordance with the present invention, there is provided an insulating screwdriver, comprising a handle, a drive shank having a first end mounted in the handle and a second end protruding outwardly from the handle, an insulating jacket mounted on the second end of the drive shank, and an identification insulating sleeve mounted between the second end of the drive shank and the insulating jacket.

Further benefits and advantages of the present invention will become apparent after a careful reading of the detailed description with appropriate reference to the accompanying drawings.

DETAILED DESCRIPTION OF THE INVENTION

Figure 1:
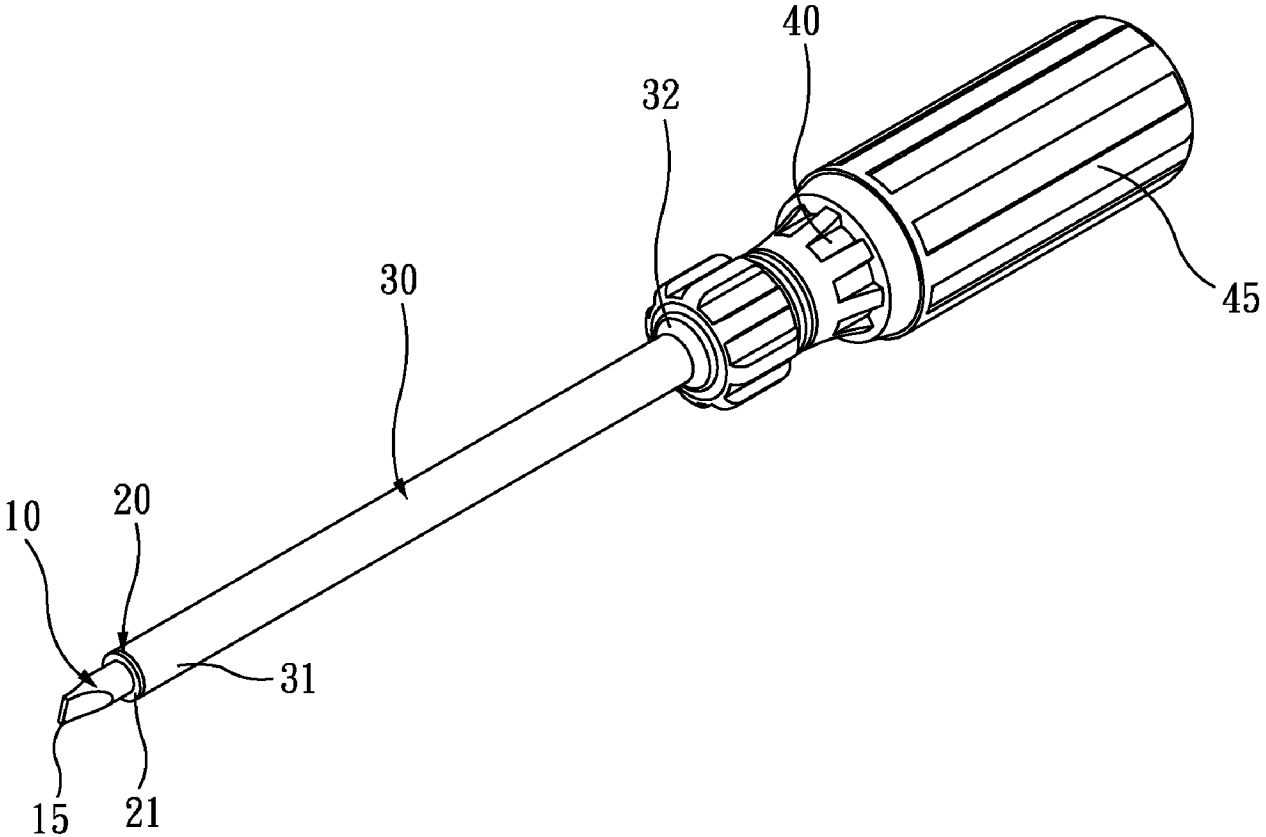
FIG. 1 is a perspective view of an insulating screwdriver in accordance with the preferred embodiment of the present invention.
Figure 2:
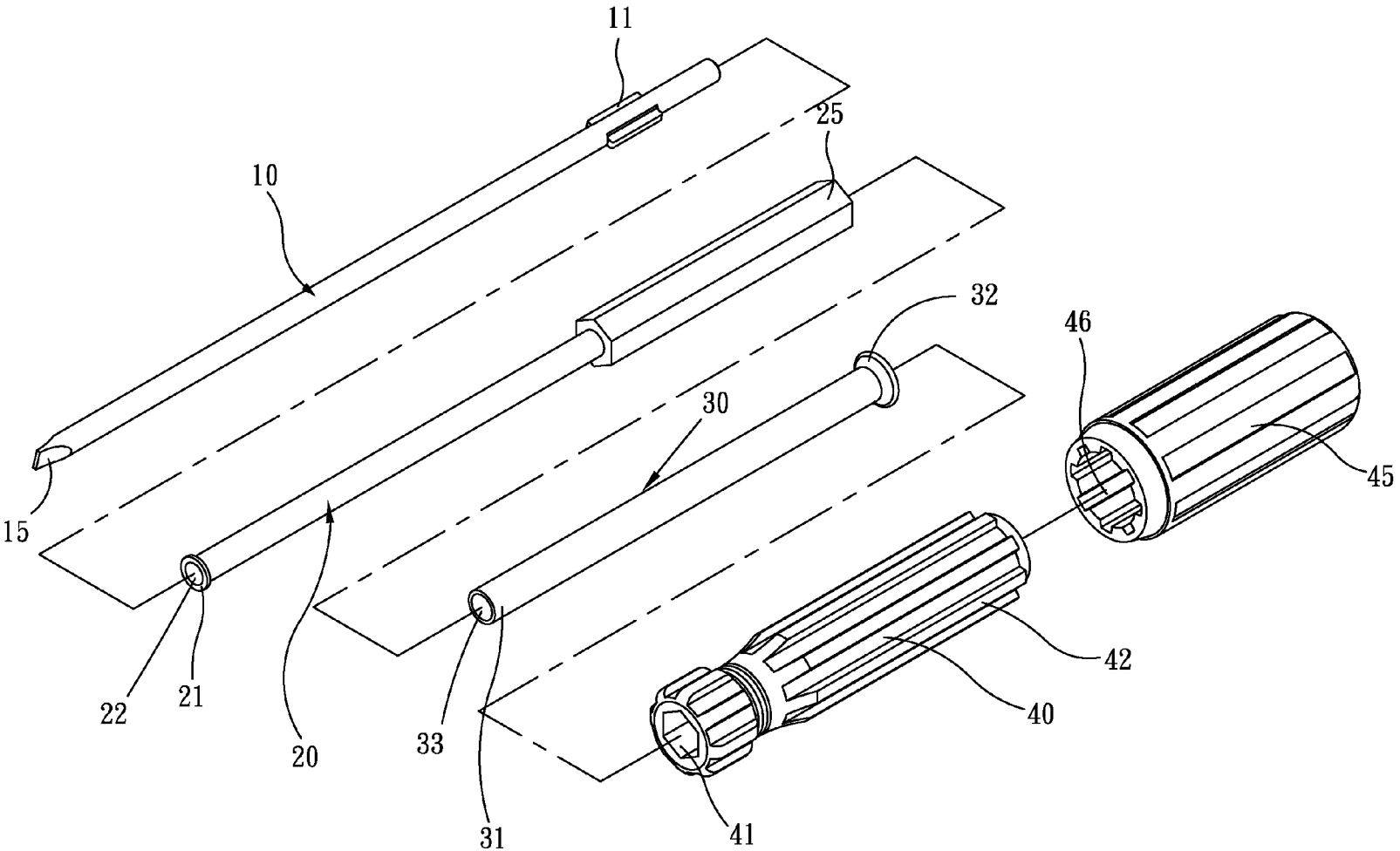
FIG. 2 is an exploded perspective view of the insulating screwdriver as shown in FIG. 1.
Figure 3:
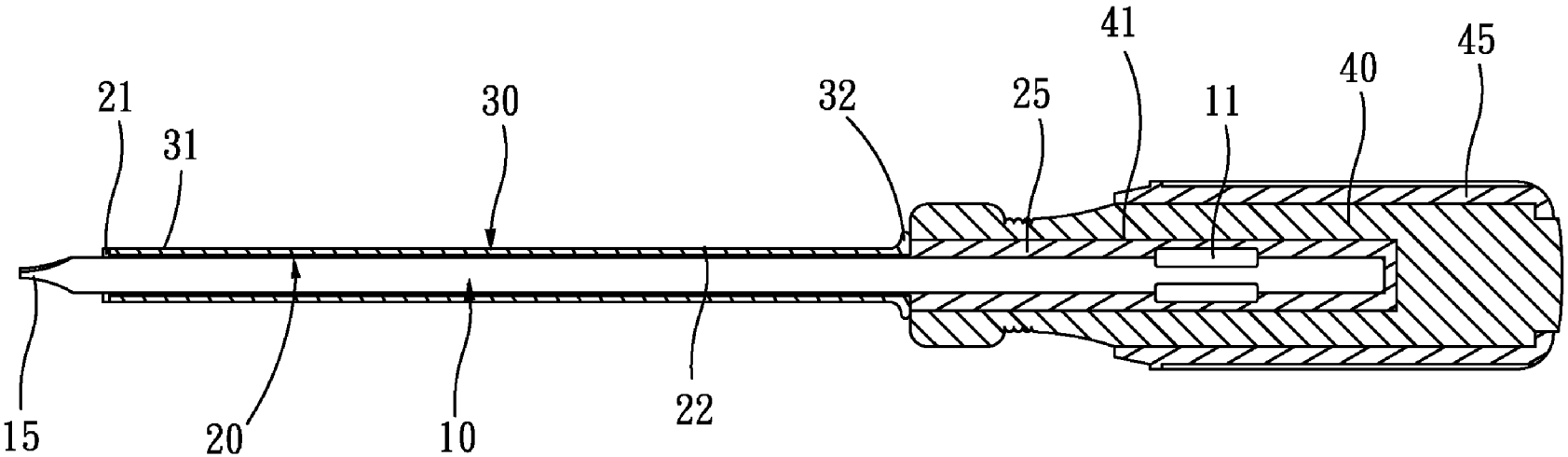
FIG. 3 is a top cross-sectional view of the insulating screwdriver as shown in FIG. 1.

Referring to the drawings and initially to FIGS. 1-3, an insulating screwdriver in accordance with the preferred embodiment of the present invention comprises a handle 40, a drive shank 10 having a first end mounted in the handle 40 and a second end protruding outwardly from the handle 40, an insulating jacket 30 mounted on the second end of the drive shank 10, an identification insulating sleeve 20 mounted between the second end of the drive shank 10 and the insulating jacket 30 and provided with an identification portion 21 protruding outwardly from the insulating jacket 30, and a grip 45 mounted on the handle 40.

The handle 40 has an inner wall provided with a receiving chamber 41 to receive the identification insulating sleeve 20 and the drive shank 10. The handle 40 has an outer wall provided with a plurality of elongate insertion keys 42. The receiving chamber 41 of the handle 40 has a polygonal shape. The handle 40 is integrally formed on the identification insulating sleeve 20 by an injection molding process.

The identification insulating sleeve 20 has a color different from that of the insulating jacket 30. The identification insulating sleeve 20 has a tubular shape and has an inner wall provided with a receiving hole 22 to receive the drive shank 10. The identification insulating sleeve 20 has a first end secured in the handle 40 and a second end protruding outwardly from the handle 40. The first end of the identification insulating sleeve 20 has an outer wall provided with an enlarged insert 25 inserted into and detachably locked in the receiving chamber 41 of the handle 40. The enlarged insert 25 of the identification insulating sleeve 20 has a polygonal shape. The second end of the identification insulating sleeve 20 has an end portion provided with the identification portion 21. The identification portion 21 of the identification insulating sleeve 20 has an annular shape and protrudes radially and outwardly from an outer wall of the identification insulating sleeve 20. The identification insulating sleeve 20 is made of an insulating material and is integrally formed on the drive shank 10 by an injection molding process.

The insulating jacket 30 is mounted on the second end of the identification insulating sleeve 20 and has a first end 31 abutting the identification portion 21 of the identification insulating sleeve 20 and a second end provided with an enlarged resting portion 32 abutting the enlarged insert 25 of the identification insulating sleeve 20 and the handle 40. The first end 31 of the insulating jacket 30 is flush with the identification portion 21 of the identification insulating sleeve 20. The insulating jacket 30 has a tubular shape and has an inner wall provided with a receiving bore 33 to receive the second end of the identification insulating sleeve 20. The insulating jacket 30 is made of an insulating material and is integrally formed on identification insulating sleeve 20 by an injection molding process.

The drive shank 10 is secured in the identification insulating sleeve 20 and has a first end provided with a drive tip 15 protruding outwardly from the identification portion 21 of the identification insulating sleeve 20 and the first end 31 of the insulating jacket 30 and a second provided with a plurality of fixing wings 11 secured in the enlarged insert 25 of the identification insulating sleeve 20.

The grip 45 has an inner wall provided with a plurality of elongate receiving splines 46 mounted on the insertion keys 42 of the handle 40. The grip 45 is made of an insulating material.

When in use, the insulating jacket 30 is located outside of the drive shank 10 to provide a primary insulating effect to the drive shank 10 so as to protect a user when operating the drive shank 10 to operate a workpiece. At this time, the identification insulating sleeve 20 is mounted between the second end of the drive shank 10 and the insulating jacket 30, so that when the insulating jacket 30 is worn out or broken due to friction or hit during a long-term utilization, the identification insulating sleeve 20 is still located outside of the drive shank 10 to provide a secondary insulating effect to the drive shank 10 so as to protect the user when operating the drive shank 10. In addition, when the insulating jacket 30 is worn out, the identification insulating sleeve 20 located in the insulating jacket 30 is exposed partially from the insulating jacket 30. At this time, the identification insulating sleeve 20 has a color different from that of the insulating jacket 30, and the identification portion 21 protrudes outwardly from the insulating jacket 30 to provide an identification function, so that the user can identify the wear condition of the insulating jacket 30, thereby achieving the safety usage of the insulating screwdriver.

Figure 4:
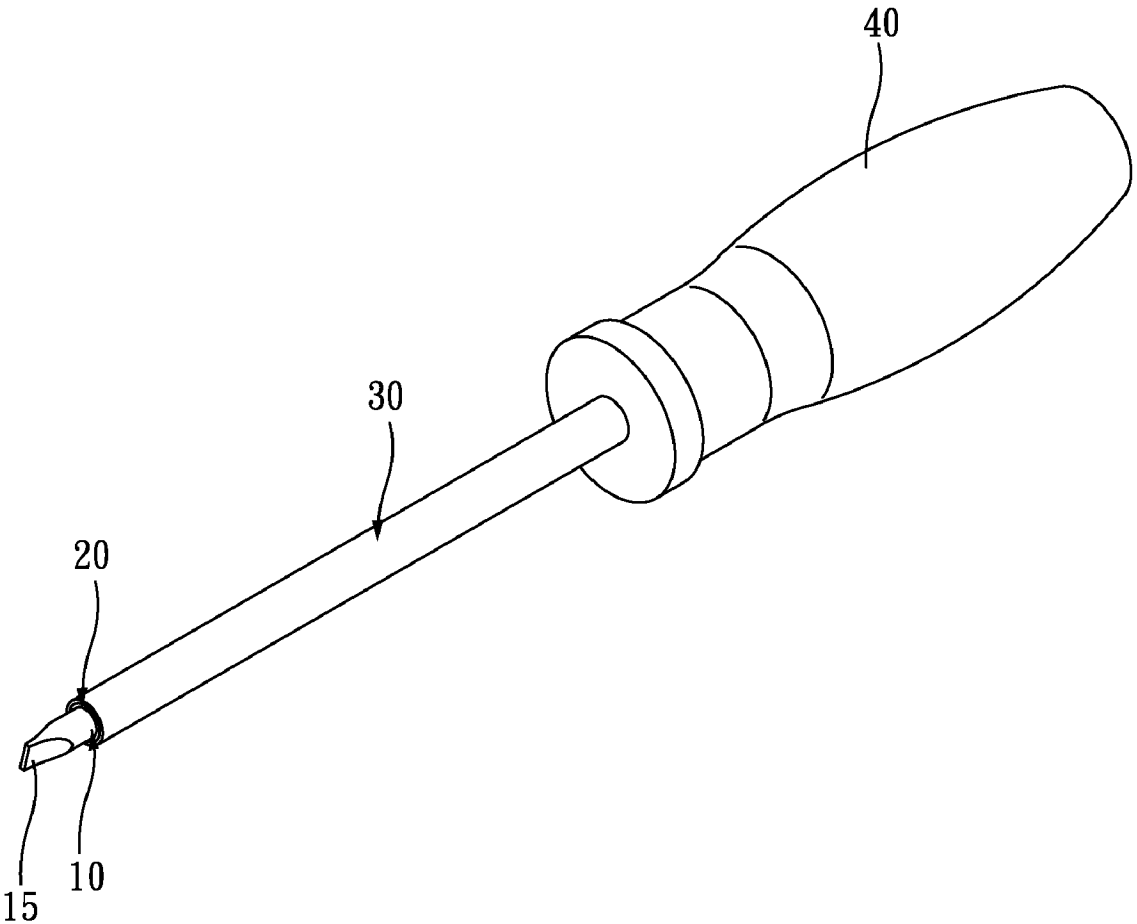
FIG. 4 is a perspective view of an insulating screwdriver in accordance with another preferred embodiment of the present invention.
Figure 5:
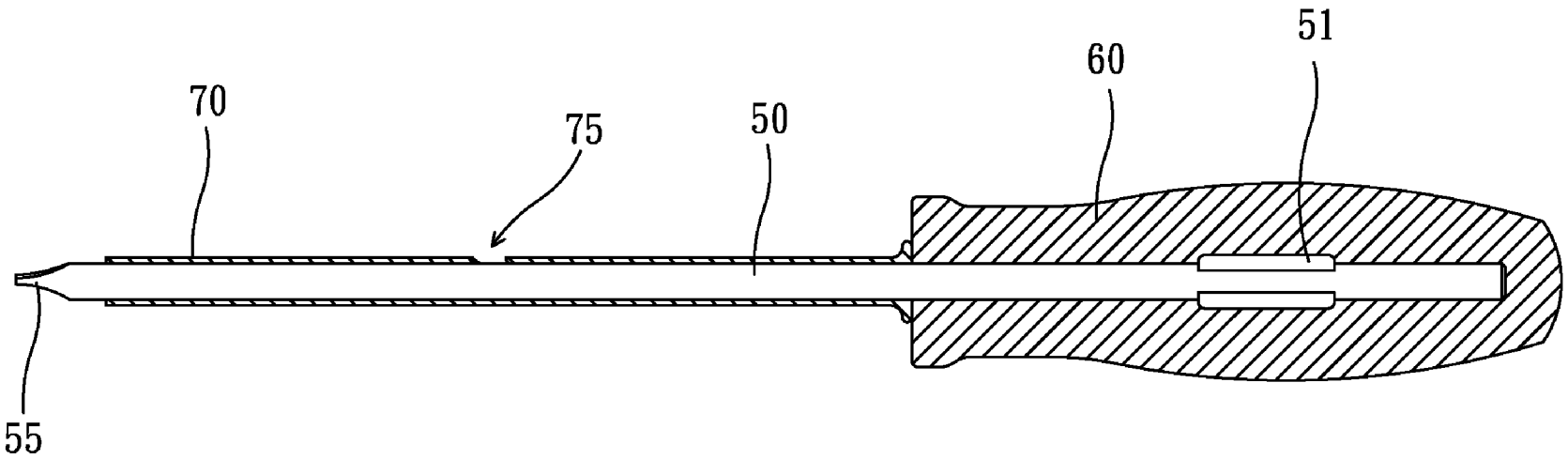
FIG. 5 PRIOR ART
FIG. 5 is a front cross-sectional view of a conventional insulating screwdriver in accordance with the prior art.

As shown in FIG. 4, the identification portion 21 of the identification insulating sleeve 20 and the grip 45 are defined.

Accordingly, the identification insulating sleeve 20 is mounted between the second end of the drive shank 10 and the insulating jacket 30, so that when the insulating jacket 30 is worn out or broken due to friction or hit during a long-term utilization, the identification insulating sleeve 20 is still located outside of the drive shank 10 to provide a secondary insulating effect to the drive shank 10 so as to protect the user when operating the drive shank 10. In addition, when the insulating jacket 30 is worn out, the identification insulating sleeve 20 located in the insulating jacket 30 is exposed partially from the insulating jacket 30 and has a color different from that of the insulating jacket 30 to provide an identification function, so that the user can identify the wear condition of the insulating jacket 30, thereby achieving the safety usage of the insulating screwdriver.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. An insulating screwdriver, comprising:

a handle;

a drive shank having a first end mounted in the handle and a second end protruding outwardly from the handle;

an insulating jacket mounted on the second end of the drive shank; and an identification insulating sleeve mounted between the second end of the drive shank and the insulating jacket, wherein the identification insulating sleeve is made with a color different from that of the insulating jacket.

2. The insulating screwdriver in accordance with claim 1, wherein the identification insulating sleeve is provided with an identification portion protruding outwardly from the insulating jacket.

3. The insulating screwdriver in accordance with claim 1, wherein the identification insulating sleeve has a first end secured in the handle and a second end protruding outwardly from the handle.

4. The insulating screwdriver in accordance with claim 3, wherein the handle has an inner wall provided with a receiving chamber to receive the identification insulating sleeve and the drive shank.

5. The insulating screwdriver in accordance with claim 4, wherein the first end of the identification insulating sleeve has an outer wall provided with an enlarged insert inserted into and detachably locked in the receiving chamber of the handle.

6. The insulating screwdriver in accordance with claim 5, wherein the receiving chamber of the handle has a polygonal shape;

the enlarged insert of the identification insulating sleeve has a polygonal shape.

7. The insulating screwdriver in accordance with claim 5, wherein the identification insulating sleeve is provided with an identification portion protruding outwardly from the insulating jacket;

the second end of the identification insulating sleeve has an end portion provided with the identification portion.

8. The insulating screwdriver in accordance with claim 7, wherein the identification portion of the identification insulating sleeve has an annular shape.

9. The insulating screwdriver in accordance with claim 7, wherein the identification portion of the identification insulating sleeve protrudes radially and outwardly from an outer wall of the identification insulating sleeve.

10. The insulating screwdriver in accordance with claim 7, wherein the insulating jacket is mounted on the second end of the identification insulating sleeve.

11. The insulating screwdriver in accordance with claim 10, wherein the insulating jacket has a first end abutting the identification portion of the identification insulating sleeve and a second end provided with an enlarged resting portion abutting the enlarged insert of the identification insulating sleeve and the handle.

12. The insulating screwdriver in accordance with claim 11, wherein the first end of the insulating jacket is flush with the identification portion of the identification insulating sleeve.

13. The insulating screwdriver in accordance with claim 11, wherein the drive shank is secured in the identification insulating sleeve and has a first end provided with a drive tip protruding outwardly from the identification portion of the identification insulating sleeve and the first end of the insulating jacket and a second provided with a plurality of fixing wings secured in the enlarged insert of the identification insulating sleeve.

14. The insulating screwdriver in accordance with claim 10, wherein the insulating jacket has a tubular shape and has an inner wall provided with a receiving bore to receive the second end of the identification insulating sleeve.

15. The insulating screwdriver in accordance with claim 1, further comprising:

a grip mounted on the handle.

16. The insulating screwdriver in accordance with claim 15, wherein the handle has an outer wall provided with a plurality of elongate insertion keys;

the grip has an inner wall provided with a plurality of elongate receiving splines mounted on the insertion keys of the handle.

17. The insulating screwdriver in accordance with claim 15, wherein the identification insulating sleeve is made of an insulating material;

the insulating jacket is made of an insulating material; and the grip is made of an insulating material.

18. The insulating screwdriver in accordance with claim 1, wherein the handle is integrally formed on the identification insulating sleeve by an injection molding process;

the identification insulating sleeve is integrally formed on the drive shank by an injection molding process; and the insulating jacket is integrally formed on identification insulating sleeve by an injection molding process.

19. The insulating screwdriver in accordance with claim 1, wherein the identification insulating sleeve has a tubular shape and has an inner wall provided with a receiving hole to receive the drive shank.

* * * * *